US005251379A

United States Patent [19]

Kuo

[11] Patent Number: 5,251,379

[45] Date of Patent: Oct. 12, 1993

[54] PAPER CUTTER

[76] Inventor: Fulton Kuo, No. 3, Lane 13, Jinn Shyne Road, 5 Lin, Jyr Yih Village, Jyr Guan Hsian, Kaohsiung Hsien, Taiwan

[21] Appl. No.: 981,550

[22] Filed: Nov. 25, 1992

[51] Int. Cl.[5] ..... B26B 29/00; B26B 29/06

[52] U.S. Cl. ..... 30/293; 30/289

[58] Field of Search ..... 30/282, 283, 286, 289, 30/290, 293, 294

[56] References Cited

U.S. PATENT DOCUMENTS

| | | | |
|---|---|---|---|
| 2,383,368 | 8/1945 | Calaghan | 30/289 |
| 4,426,781 | 1/1984 | Kufrin | 30/289 |
| 4,602,433 | 7/1986 | Whiting | 30/293 |
| 4,667,409 | 5/1987 | D'Amato | 30/289 |
| 4,864,729 | 9/1989 | Fumger | 30/290 |
| 4,979,612 | 12/1990 | Melbye | 30/290 |
| 5,048,188 | 9/1991 | Wolff | 30/294 |

*Primary Examiner*—Frank T. Yost
*Assistant Examiner*—Paul M. Heyrana, Sr.
*Attorney, Agent, or Firm*—Notaro & Michalos

[57] ABSTRACT

A paper cutter particularly one comprising a base, a cutter holder, a blade, a spring wire, an adjusting spring plate, an adjusting knob, an intermediate plate, and a top cover in which a notch is designed at a corner of the base for extension of a blade, the cutter holder is pressed by the adjusting knob with a plurality of protuberances of different diameters to adjust the extent of blade extension for cutting of paper of different thickness without damaging paper beneath it, and the cutting is proceeded by sliding a flange of the base on the paper to assure precise cutting.

1 Claim, 3 Drawing Sheets

PAPER CUTTER

DETAILED DESCRIPTION OF THE PREFERRED EMBODIMENT

There are many occasions requiring cutting of papers. In addition to fine arts in school, press clipping and cutting of pictures from books and magazines requires paper cutter.

Conventionally scissors or blades are used to cut from margins, but it is impossible to cut a certain portion from the middle of paper. Moreover, insertion of papers would damage paper and make data incomplete. Use of blade does not permit even application of force, and hence can not control depth of cutting, thus table surface or other material would be damaged. If pad or glass is placed beneath the paper to the cut, the thickness of such pad or glass would prevent from cutting of any page from the margin within the book.

Cutting of a complete page, or any picture from the middle of a page in a book with scissors or blade is difficult and may damage binding of the book. It is a common experience that cutting of complete page or picture would damage book or magazine.

In view of the above defects, the inventor has created a paper cutter to permit precise cutting, assure safe operation and allow adjustment of thickness of cutting after a prolonged research and development with repeated experiments.

For embodiment of the present invention, please kindly refer to the attached drawings, in which FIG. 1 is a perspective fragmented view of the present invention;

FIG. 2 illustrating the present invention when it is half assembled;

Figure 1:
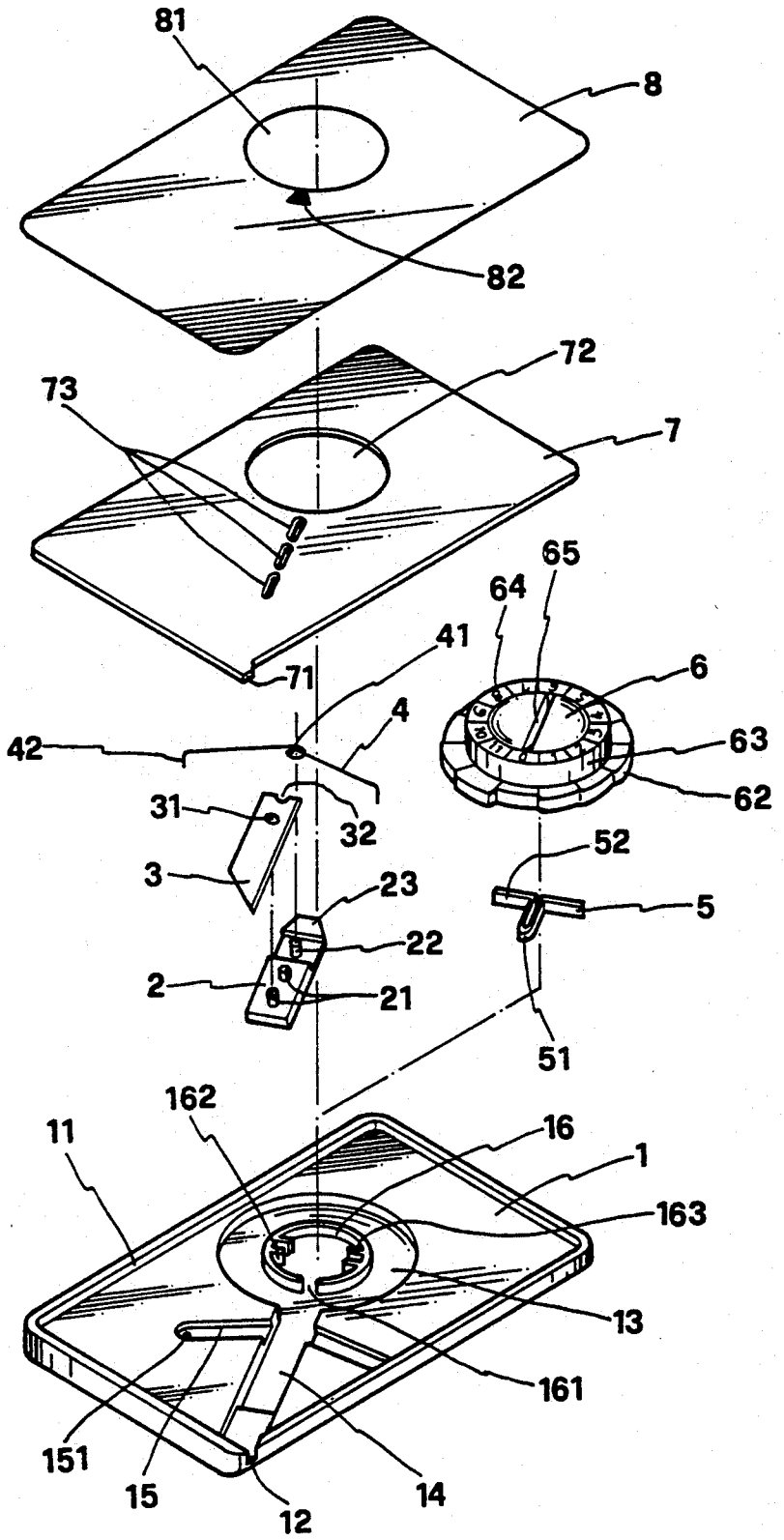

As shown in the drawings, the paper cutter comprises mainly a base 1, a cutter holder 2, a blade 3, a spring wire 4, an adjusting spring plate 5, an adjusting knob 6, an intermediate plate 7, and a top cover 8.

As shown in the drawings, the cutter paper according to the present invention comprises mainly a base 1, a cutter holder 2, a blade 3, a spring wire 4, an adjusting spring plate 5, an adjusting knob 6, an intermediate plate 7 and a top cover 8.

The base 1 is a plate with a flange 11 extended along its edges. The base shown in the embodiment shown is rectangular, but it can be formed in any other shape in other embodiment. A notch 12 having a height of about one-half of the height of the flange 11 is formed at a corner for extension of the blade 3. A circular recession 13 is formed at a middle section surrounded by the flange 11. The recession 13 is extended till the notch 12 to form a slot 14. The slot 14 has two recessed wing portions 15 each extended from a side of the slot 14. A wing hole 151 is formed at the end of each wing portion 15. An annular projection 16 is formed at the middle of the recession 13. An opening 161 facing the notch 12 is formed, at the annular projection 16. Two pairs of tenons 162 are formed at the annular projection 16 at such positions 90 degree from the opening 161 so as to form a catch 163 in the middle of each pair of the tenons 162 for fixing of an adjusting spring plate 5.

The cutter holder 2 is for holding of a blade 3. On the cutter holder 2 there are two tenon elements 21, one for placing and positioning of the blade 3 with a hole 31 formed on the blade 3, and the other for seizing and positioning of a notch 32 at an end of the blade 3. Behind the tenon elements 21 there is a post 22 for fixing of a spring wire 4. The rear side of the cutter holder 2 is a slope 23 keeping contact with an adjusting knob 6.

The blade 3 has a conventional beveled front edge. As described above, it has a hole 31 for fixing to a tenon element 21, and a notch 32 in the middle of its rear end for fixing to another tenon element 21 to position the blade 3 in place.

The spring wire is a wire spring having a hole 41 in the middle and a bent end 42 at the tip of each wire extending laterally so that each of the bent end 42 can be inserted to a wing hole 151 mentioned above after the hole 41 is fixed to the post 22 of the cutter holder 2, and hence the cutter holder 2 and the blade 3 are positioned on the slot 14, and the spring wire 4 is positioned by the wing portions 15.

The adjusting spring plate 5 is made of a rigid material turned to form a front tip 51 and two wings 52. Each wings 52 can be retained in the said catch 163 in a way that the front tip 51 is facing the slot 14.

Figure 4A:
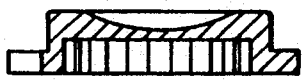
FIG. 4 is a plan view, with FIG. 4A being a sectional view illustrating the adjusting knob according to the present invention.
Figure 4:
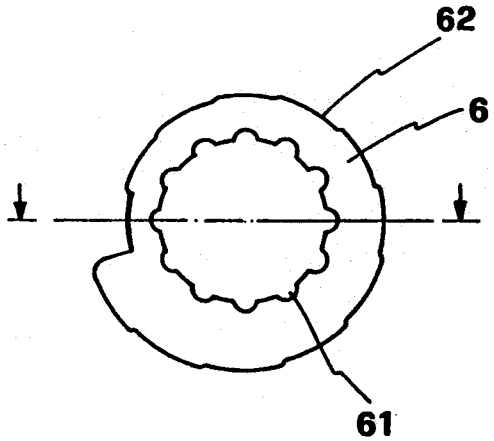

The adjusting knob 6 is a hollow knob structure as shown in FIG. 4. There is a plurality of recessions 61 of equal diameter along the inner wall of the adjusting knob 6, and a plurality of worm-like protuberances 62 of different diameters which can be placed in the circular recession 13 and rotated therein. When the front tip 51 of the adjusting spring plate 5 keeps contact with the a recession 61, the recessions 612 are subject to different pressure and squeeze. A cylindrical body 63 is extended upward from its center. The top surface of the cylindrical body 63 is marked with some divisions 64 and a slot 65 is formed for adjustment of the knob with a coin or the like.

The intermediate plate 7 is a plate having a size and shape corresponding to the base 1 for placing on the base 1. A tab 71 is formed at a position corresponding to the notch 12 so that the notch 12 can be fitted therein to cover the blade 3. A middle hole 72 is formed corresponding to the cylindrical body 63 so that the cylindrical body 63 is exposed after fixing. A slot 73 is formed corresponding to the post 22 and the tenon elements 21 to secure the spring wire 4, the cutter holder 2 and the blade 3.

The top cover 8 is a plate having a size and shape corresponding to the base 1 for fixing it to the base. An opening 81 is formed on the cover 8 at a position corresponding to the cylindrical body 63. A mark 82 is formed on the cover 8 to indicate the degree of cutting with reference to the divisions 64 on the adjusting knob 6.

Figure 2:
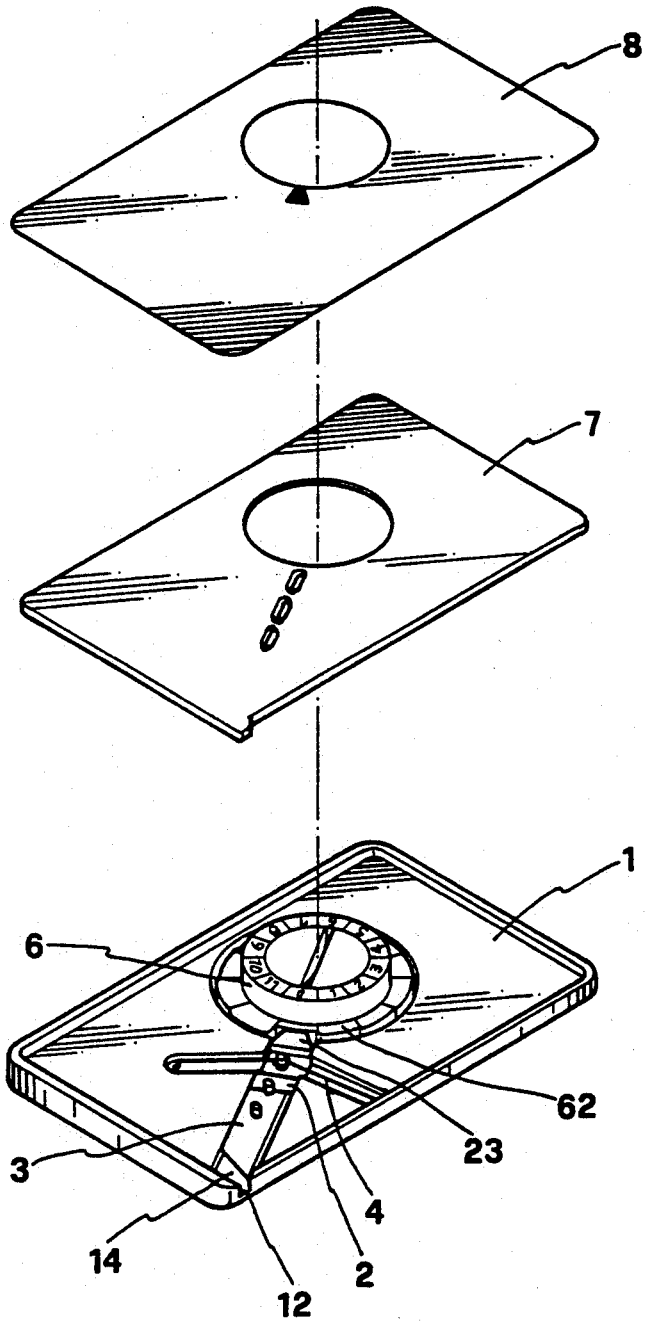
Figure 3:
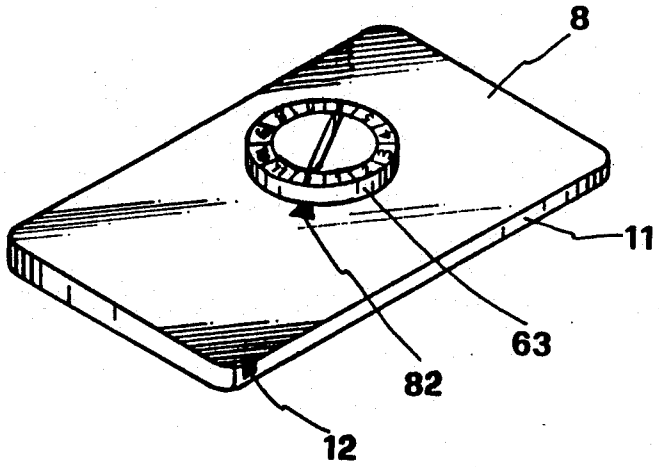
FIG. 3 is a perspective view of the present invention after assembly.

Please refer to FIGS. 2 and 3, after assembly of the present invention, the cutter holder 2 and the blade 3 are placed in the slot 14 and retained therein by the spring wire 4. The slope 23 of the cutter holder 2 is kept contact with the protuberances 62 because the recession 61 is pressed by the adjusting spring plate 5, and consequently the tip of the blade 3 is exposed out of the notch 12 to constitute a cutting condition.

As the thickness of paper to be cut may vary from piece to piece, the adjusting knob 6 is used for adjustment. To cut thicker paper, the adjusting knob 6 is turned to the outermost protuberances 62 so that a longer tip of the blade 3 is exposed out of the notch 12 to get contact with the paper to be cut and cut the papers linearly.

In practice, the travel of the blade 3 is set as 0.22 mm presenting the difference between the thinnest and the thickest positions on the adjusting knob 6. The adjusting knob 6 is marked with eleven divisions of 0.02 mm each. The thickness of a normal bible paper is 0.04 mm. Therefore, the present invention can cut off only a page of bible paper without damaging the page below it.

In application, the degree of exposure of the blade 3 can be adjusted according to thickness of paper to be cut, and a sliding of the flange 11 on the paper can complete the cutting. It eliminate the defect of the conventional paper cutter which requires an application of force according to "feeling" upon cutting. Moreover, its blade can be retracted completely after using to assure safety.

The above description disclosed only a preferred embodiment of the present invention. Many changes and modifications in the above described embodiment of the invention can, of course, be carried out without departing from the scope thereof by any persons skilled in the art. Accordingly, the invention is disclosed and is intended to be limited only by the scope of the appended claims.

As described above, the present invention has some technical characteristics which are entirely different from the prior art in objective, measures and effects, and its is a practical creation which meets the requirements for model utility.

I claim:

1. A paper cutter comprising a base in the form of a plate with a flange extended along its edges, a notch at a corner for extension of a blade, a circular recession at the middle and extended till the notch to form a wing slot with two recessed wing portions each extended from a side of the slot, a hole at the end of each wing portion, an annular projection at the middle of the recession, an opening facing the notch at the annular projection, and two sets of tenons at the annular projection at such positions 90 degree from the opening so as to form a catch 163 in the middle of each set of the tenons;

a cutter holder located within the slot and having two tenon elements on it, a post behind the tenon elements, and a slope on the back side;

a blade having a conventional beveled front edge, a hole for fixing to a tenon element, and a notch for fixing to another tenon element;

a spring wire in the form of a wire spring located in the wing slot, having a hole in the middle for fixing to the post, and a bent end at the tip of each wire extending laterally so that each of the bent end can be inserted to a wing hole;

an adjusting spring plate made of a rigid material turned to form a front tip and two wings perpendicular to the front tip and retained in the said catches respectively;

an adjusting knob in the form of a hollow knob structure having a plurality of recessions of equal diameter along the inner wall and a plurality of worm-like protuberances of different diameters, a cylindrical body extended upward from its center with some divisions marked on it, and a coin slot at the middle for turning of the knob;

an intermediate plate having a size and shape corresponding to the base for placing on the base, a tab at a position corresponding to the notch so that the notch can be fitted therein to cover the blade, a middle hole corresponding to the cylindrical body so that the cylindrical body is exposed after fixing, and a slot corresponding to the post and the tenon elements to secure the cutter holder and the blade;

a top cover in the form of a plate having an opening at a position corresponding to the cylindrical body, a mark on the cover;

whereby the blade is exposed out of the notch for cutting while the cutter holder is retained by a protuberance of the adjusting knob and the thickness of cutting is adjustable by selection of protuberance of different diameter.

* * * * *